US005922668A

United States Patent [19]

Leonard et al.

[11] Patent Number: 5,922,668

[45] **Date of Patent: *Jul. 13, 1999**

[54] STABLE MICROEMULSION CLEANING COMPOSITION

[75] Inventors: Isabelle Leonard, Mons; Julien Drapier, Seraing, both of Belgium

[73] Assignee: Colgate-Palmolive Co., Piscataway, N.J.

[ * ] Notice: This patent is subject to a terminal disclaimer.

[21] Appl. No.: 09/109,691

[22] Filed: Jul. 2, 1998

Related U.S. Application Data

[63] Continuation-in-part of application No. 08/797,080, Feb. 10, 1997, Pat. No. 5,780,415.

[51] Int. Cl.[6] ..... C11D 1/83; C11D 3/20

[52] U.S. Cl. ..... 510/417; 510/182; 510/238; 510/239; 510/422; 510/423; 510/424; 510/425; 510/437; 510/365; 510/501; 510/505; 510/506

[58] Field of Search ..... 510/417, 365, 510/506, 505, 424, 238, 239, 422, 423, 501, 182, 437, 421, 429

[56] References Cited

U.S. PATENT DOCUMENTS

| | | | |
|---|---|---|---|
| 5,100,697 | 3/1992 | Nielsen | 427/33 |
| 5,108,643 | 4/1992 | Loth et al. | 252/174.11 |
| 5,527,485 | 6/1996 | DeGuertechin et al. | 252/162 |
| 5,780,415 | 7/1998 | Leonard et al. | 510/417 |

*Primary Examiner*—Yogendra N. Gupta
*Assistant Examiner*—Gregory E. Webb
*Attorney, Agent, or Firm*—Richard E. Nanfeldt

[57] ABSTRACT

A composition comprising at least one anionic surfactant, a cosurfactant, an aliphatic organic ester and water.

5 Claims, No Drawings

STABLE MICROEMULSION CLEANING COMPOSITION

RELATED APPLICATION

This application is a continuation in part application of U.S. Ser. No. 8/797,080 filed Feb. 10, 1997 now U.S. Pat. No. 5,780,415.

FIELD OF THE INVENTION

This invention relates to a stable microemulsion cleaning composition and to processes for manufacture and use thereof. More particularly, it relates to a stable aqueous microemulsion cleaning composition which is especially effective to clean oily and greasy soils from substrates such as bathroom fixtures and walls, leaving such surfaces clean and shiny without the need for extensive rinsing thereof. The described compositions comprise a mixture of at least one surfactant, a water insoluble aliphatic ester, water and a suitable cosurfactant system, which cosurfactant system adjusts the interface conformation to reduce interfacial tension at interfaces between dispersed and continuous phases of the emulsion to produce a stable normally clear microemulsion at room temperature.

BACKGROUND OF THE INVENTION

Liquid detergent compositions, usually in solution or emulsion form, have been employed as all-purpose detergents and have been suggested for cleaning hard surfaces such as painted woodwork, bathtubs, sinks, tile floors, tiled walls, linoleum, paneling and washable wallpaper. Many such preparations, such as those described in U.S. Pat. Nos. 2,560,839, 3,234,138, and 3,350,319 and British Patent Specification No. 1223739, include substantial proportions of inorganic phosphate builder salts, the presence of which can sometimes be found objectionable for environmental reasons and also because they necessitate thorough rinsing of the liquid detergent from the cleaned surface to avoid the presence of noticeable depositings of phosphate thereon. In U.S. Pat. Nos. 4,017,409 and 4,244,840 liquid detergents of reduced phosphate builder salt contents have been described but such may still require rinsing or can include enough phosphate to be environmentally objectionable. Some liquid detergents have been made which are phosphate-free, such as those described in U.S. Pat. No. 3,935,130, but these normally include higher percentages of synthetic organic detergent which increased detergent content may be objectionable due to excessive foaming during use that can result from its presence. The previously described liquid detergent compositions are emulsions but are not disclosed to be microemulsions like those of the present invention.

Microemulsions have been disclosed in various patents and patent applications for liquid detergent compositions which may be useful as hard surface cleaners or all-purpose cleaners, and such compositions have sometimes included detergent, solvent, water and a cosurfactant. Among such disclosures are European Patent Specification No's. 0137615, 0137616, and 0160762, and U.S. Pat. No. 4,561,448, all of which describe employing at least 5% by weight of the solvent in the compositions. The use of magnesium salts to improve grease removing performance of solvents in microemulsion liquid detergent compositions is mentioned in British Patent Specification No. 2144763. Other patents on liquid detergent cleaning compositions in microemulsion form are U.S. Pat. Nos. 3,723,330, 4,472,291, and 4,540,448. Additional formulas of liquid detergent compositions in emulsion form which include hydrocarbons, such as terpenes, are disclosed in British Patent Specifications No's. 1603047 and 2033421, European Specification No. 0080749, and U.S. Pat. Nos. 4,017,409, 4.414,128, and 4,540,505. However, the presence of builder salt in such compositions, especially in the presence of magnesium compounds, tends to destabilize the microemulsions and therefore such builders are considered to be undesirable.

Although the cited prior art relates to liquid all-purpose detergent compositions in emulsion form and although various components of the present compositions are mentioned in the art, it is considered that the art does not anticipate or make obvious stable aqueous microemulsion cleaning composition, which may be in concentrated or dilute form, comprises at least two different anionic synthetic organic detergent, a water insoluble organic compound, water and a cosurfactant system, which cosurfactant system adjusts interfacial conformation to reduce interfacial tension at interfaces between dispersed and continuous phases of an emulsion to produce a stable concentrated microemulsion which has a pH in the range of 1 to 11. Both concentrated and diluted compositions are effective for cleaning oily and greasy soils from substrates.

SUMMARY OF THE INVENTION

The present invention provides an improved liquid cleaning composition in the form of a microemulsion which is suitable for cleaning hard surfaces having greasy build-up deposited thereon, such as plastic, vitreous and metal surfaces, all of which may have shiny finishes. While the all-purpose cleaning composition may also be used in other cleaning applications, such as removing oily soils and stains from fabrics, it is primarily intended for cleaning hard, shiny surfaces, and desirably requires little or no rinsing. The improved cleaning compositions of the invention exhibit superior grease removal actions, especially when used in concentrated form, and leave the cleaned surfaces shiny, sometimes without any need for rinsing them. Little or no residue will be seen on the cleaned surfaces, which overcomes one of the significant disadvantages of various prior art products, and the surfaces will shine, even after little or no wiping thereof. Surprisingly, this desirable cleaning is accomplished even in the absence of polyphosphates or other inorganic or organic detergent builder salts.

GENERAL DESCRIPTION OF THE INVENTION

In one aspect of the invention, a stable, clear, all-purposed hard surface cleaning composition which is especially effective in the removal of oily and greasy soils from hard surfaces, is in the form of a microemulsion.

The compositions of the instant invention which are preferably microemulsions especially designed for superior removal of grease deposits on hard surfaces comprise approximately by weight:

a) 6% to 50%, more preferably 8% to 40% of at least one surfactant selected from the group consisting of anionic surfactants and zwitterionic surfactants and mixtures thereof;

b) 0.5 to 20%, more preferably 0.7% to 8% of at least water insoluble organic ester;

c) 0 to 22%, more preferably 0.5% to 10% of a solubilizing agent;

d) 0 to 25%, more preferably 0.5% to 15% of at least one cosurfactant; and f) the balance being water, wherein the composition has a pH of about 1 to about 11, more preferably about 5 to about 9 and is optically clear having at least 90% light transmission, more preferably at least 95% and the interfacial tension between the lipophile droplets and the aqueous phase is less than about $10^{-2}$ mN/m, more preferably less than about $10^{-3}$ mN/m, wherein the composition is not an emulsion and the composition contains less than 0.25 wt. % of a perfume and the composition does not contain a nonionic surfactant which is an ethoxylated $C_4$–$C_{15}$alkyl or di-$C_{4-15}$ alkyl phenol, ethoxylated $C_{8-22}$ fatty alcohol or a polyethylene glycol ester of a $C_{10-22}$ fatty acid.

Preferred concentrations of the mentioned components of the concentrated microemulsion are 6 to 50 wt. % of at least one synthetic organic surfactant, 1 to 20 wt. % the water insoluble ester compound, 1 to 14 wt. % of cosurfactant system, and the balance being water. At such preferred concentrations, upon dilution of one part of concentrate with four parts of water the resulting microemulsion will be low in detergent and solvent contents, which may be desirable to avoid excessive foaming and to prevent destabilization of the emulsion due to too great a content of lipophilic phase therein after dissolving in the suitable hydrocarbon or other solvent of the oily or greasy soil to be removed from a substrate to be cleaned. Because of the absence of builders when the cleaning composition consists of or consists essentially of the described components (with minor proportions of compatible adjuvants being permissible), a chalky appearance of the clean surface is avoided and rinsing may be obviated. Among the desirable adjuvants that may be present in the microemulsions are divalent or polyvalent metal salts, as sources of magnesium and aluminum, for example, which improve cleaning performances of the dilute compositions, and higher fatty acids and/or higher fatty acid soaps, such as sodium stearate at a concentration of about 1.0 to 5.0 wt. percent which act in preserving the clarity of the product. Of course, if it is considered aesthetically desirable for the normally clear microemulsions to be cloudy or pearlescent in appearance, an opacifying or pearlescing agent may be present and in some instances, when it is not considered disadvantageous to have to rinse the builder off the substrate, builder salts, such as polyphosphates, may be present in the microemulsions, but it should be stressed that normally builders will be absent from them.

Although most of the microemulsions of this invention are of the oil-in-water type, some may be water-in-oil (w/o), especially the concentrates. Such may change to on dilution with water, but both the and w/o microemulsions are stable. However, the preferred detergent compositions are oil-in-water microemulsions, whether as concentrates of after dilution with water, with the essential components thereof being detergent, water insoluble organic compound, cosurfactant and water.

The $C_{8-18}$ethoxylated alkyl ether sulfate surfactants used in the instant composition have the structure $$R—(OCHCH_2)_nOSO_3^-M^+$$

wherein n is about 1 to about 22 more preferably 1 to 3 and R is an alkyl group having about 8 to about 18 carbon atoms, more preferably 12 to 15 and natural cuts, for example, $C_{12-14}$; $C_{12-15}$ and M is an ammonium cation or an alkali metal cation, most preferably sodium or ammonium. The ethoxylated alkyl ether sulfate is present in the composition at a concentration of about 0.5 wt. % to about 14 wt. %, more preferably about 2 wt. % to 12 wt. %.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 20 carbon atoms in the alcohols and in the alkyl groups thereof.

Ethoxylated $C_{8-18}$ alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol. The concentration of the ethoxylated alkyl ether sulfate surfactant is about 1 to about 8 wt. %.

Examples of suitable sulfonated anionic surfactants used in the instant compositions are the well known higher alkyl mononuclear aromatic sulfonates such as the higher alkyl benzene sulfonates containing from 10 to 16 carbon atoms in the higher alkyl group in a straight or branched chain, $C_8$–$C_{15}$ alkyl toluene sulfonates and $C_8$–$C_{15}$ alkyl phenol sulfonates.

A preferred sulfonate is linear alkyl benzene sulfonate having a high content of 3- (or higher) phenyl isomers and a correspondingly low content (well below 50%) of 2-(or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position is correspondingly low. Particularly preferred materials are set forth in U.S. Pat. 3,320,174. Preferably the magnesium salt of the linear alkyl benzene sulfonate is employed but a mixture of a sodium salt of a linear alkyl benzene sulfonate and a magnesium salt of a linear alkyl benzene sulfonate can be used.

Other suitable anionic surfactants are the olefin sulfonates, including long-chain alkene sulfonates, long-chain hydroxyalkane sulfonates or mixtures of alkene sulfonates and hydroxyalkane sulfonates. These olefin sulfonate detergents may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. Preferred olefin sulfonates contain from 14 to 16 carbon atoms in the R alkyl group and are obtained by sulfonating an alpha-olefin.

Other examples of suitable anionic sulfonate surfactants are the paraffin sulfonates containing about 10 to 20, preferably about 13 to 17, carbon atoms. Primary paraffin sulfonates are made by reacting long-chain alpha olefins and bisulfites and paraffin sulfonates having the sulfonate group distributed along the paraffin chain are shown in U.S. Pat. Nos. 2,503,280; 2,507,088; 3,260,744; 3,372,188; and German Patent 735,096.

The water-soluble zwitterionic surfactant (betaine), which can also be present in the instant composition, constitutes about 0 wt. % to 12 wt. %, preferably 1 wt. % to 10 wt. %, and provides good foaming properties and mildness to the present nonionic based liquid detergent. The zwitterionic surfactant is a water soluble betaine having the general formula:

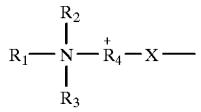

wherein X is selected from the group consisting of $CO_{2-}$ and $SO_{3-}$ and wherein $R_1$ is an alkyl group having 10 to about 20 carbon atoms, preferably 12 to 16 carbon atoms, or the amido radical:

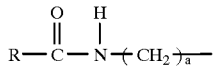

wherein R is an alkyl group having about 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N, N-dimethyl-ammonia) acetate, coco dimethyl betaine or 2-(N-coco N, N-dimethylammonia) acetate, myristyl dimethyl betaine, palmityl dimethyl betaine, lauryl dimethyl betaine, cetyl dimethyl betaine, stearyl dimethyl betaine, etc. The amidobetaines similarly include cocoamidoethylbetaine, cocoamidopropyl betaine and the like. A preferred betaine is coco ($C_8$–$C_{18}$) amidopropyl betaine.

The instant compositions can optionally contain 0 to about 6 wt. %, more preferably about 0.5 wt. % to about 5 wt. % of an amine oxide such as cocoamidopropyl dimethyl amine oxide or a $C_8$–$C_{18}$ alkyl dimethyl amine oxide.

The instant compositions can optionally contain about 0 to about 10 wt. %, more preferably 1 wt. % to 8 wt. % of an alkyl polysaccharide surfactant. The alkyl polysaccharides surfactants, which are used in conjunction with the aforementioned surfactant have a hydrophobic group containing from about 8 to about 20 carbon atoms, preferably from about 10 to about 16 carbon atoms, most preferably from about 12 to about 14 carbon atoms, and polysaccharide hydrophilic group containing from about 1.5 to about 10, preferably from about 1.5 to about 4, most preferably from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4- positions rather than at the 1 -position, (thus giving e.g. a glucosyl or galactosyl as opposed to a glucoside or galactoside). However, attachment through the 1- position, i.e., glucosides, galactoside, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$RO(C_nH_{2n}O)_r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3 preferably 2, r is from 0 to 10, preferable 0; and x is from 1.5 to 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1OH$) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucoside content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is APG 625 glycoside manufactured by the Henkel Corporation of Ambler, PA. APG25 is a nonionic alkyl polyglycoside characterized by the formula:

$C_nH_{2n+1}O(C_6H_{10}O_5)_xH$ wherein n=10 (2%); n=122 (65%); n=14 (21–28%); n=16 (4–8%) and n=18 (0.5%) and x (degree of polymerization) =1.6. APG 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C. 21 spindle, 5–10 RPM of 3,000 to 7,000 cps. Another preferred APG glucoside surfactant is APG 220 also manufactured by the Henkel Corporation.

The instant composition can also optionally include 0 to about 5 wt. %, more preferably about 0.5 wt. % to about 4 wt. % of a low molecular weight glucoside surfactant such as butyl glucoside.

The viscosity and clarity control system for the composition can comprise a solublizing agent such as urea and a lower $C_2$–$C_4$ aliphatic alcohol, and optionally a water soluble hydrotrope which is effective in promoting the compatibility of the ingredients in the microemulsion composition and can be substituted for part of the urea or alcohol. Generally, the viscosity and clarity control system is required in concentrated liquid compositions containing at least 30 wt % by weight of active ingredients.

Suitable hydrotropic substances are the alkali metal organic sulphonated (including sulphated) salts having an alkyl group up to 6 carbon atoms. The preferred sulphonated hydrotropes are alkyl aryl sulphonates having up to 3 carbon atoms in the alkyl group, e.g. the sodium and potassium xylene, toluene, ethylbenzene and isopropyl benzene (cumene) sulphonates. Sulphonates made from xylene include orthoxylene sulphonate, metaxylene sulphonate, paraxylene sulphonate and ethylbenzene sulphonate. Commercial xylene sulphonates usually contain metaxylene sulphonate as the main ingredient. Analysis of typical commercial xylene sulphonate products shows about 40 to 50% metaxylene sulphonate, 10 to 35% orthoxylene sulphonate and 15 to 30% paraxylene sulphonate with 0 to 20% ethylbenzene sulphonate. Any suitable isomeric mixture, however, may be employed. Sodium cumene sulphonate and sodium xylene sulphonate are preferred alkyl aryl sulphone hydrotropes for use in the compositions of the present invention. It is also permissible to use suitably alkyl sulphate salts having 5 or 6 carbon atoms in the alkyl group such as alkali metal n-amyl and n-hexylsulphates.

The use of the viscosity and clarity control system can impart superior low temperature clarity of the liquid detergent composition and provides control of the viscosity of the product over a wider range for any particular concentration of active ingredients, as will be set forth in greater detail hereinafter. The alcohols preferably have 2 or 3 carbon atoms. Thus, ethyl alcohol, propyl alcohol, isopropyl alcohol or propylene glycol can be used; preferably ethyl alcohol will be used.

The proportions of urea, alcohol and hydrotropic substance best suited for any particular composition depend on the active ingredient components and proportions and can be determined by the formulator by conventional tests. The weight content of this viscosity and control system based upon the total composition will vary from 0 to 22% and preferably is from 0.5 to 10%. Within that range solublizing will vary within the ranges of from 0 to 8.0%, preferably from 0.5 to 6%, and the cosurfactant will be from 0 to 14%, preferably 0.15 to 10%. The ratio of alcohol to urea is maintained below 1.3:1, preferably below 1:1 and most preferably is in the range from 0.37:1 to 0.85:1 when using an active ingredient content above 30% by weight, preferably 35 to 45%. Varying amounts of hydrotrope such a xylene sulphonate may be added or substituted in part for the alcohol or urea so as to form a ternary system with special properties such as markedly to increase the viscosity. The amount should be selected so as to maintain a satisfactory viscosity and cloud point and maintain other desirable properties. Generally, the hydrotrope may constitute up to 15% by weight of the total viscosity and control system.

The composition can contain 0 to 10 wt. %, more preferably 0.5 wt. % to 6 wt. % of urea, 0 to 9%, more preferably 0.3 wt. % to 7 wt. % of a $C_2$–$C_4$ alkanol and 0 to 5 wt. %, more preferably 0.1 wt. % to 3 wt. % of a $C_{1-3}$ alkyl aryl sulphonate.

The amount of cosurfactant employed to stabilize the microemulsion compositions of the instant invention will depend on such factors as the surface tension characteristics of the cosurfactant, the types and proportions of the surfactants, and the types and proportions of any additional components which are present in the composition and which have an influence on the thermodynamic factors previously enumerated. Generally, amounts of cosurfactant in a preferred range of 0 to 25%, more preferably 0.5 to 15%, and especially preferred 1 to 10%, provide stable microemulsions.

The major class of compounds found to provide highly suitable cosurfactants for the microemulsion over temperature ranges extending from 5° C. to 43° C. for instance are glycerol, ethylene glycol, water-soluble polyethylene glycols having a molecular weight of 300 to 1000, polypropylene glycol of the formula $HO(CH_3CHCH_2O)_nH$ wherein n is a number from 2 to 18, mixtures of polyethylene glycol and polypropyl glycol (Synalox) and mono $C_1$–$C_6$ alkyl ethers and esters of ethylene glycol and propylene glycol having the structural formulas $R(X)_nOH$ and $R_1(X)_nOH$ wherein R is $C_1$–$C_6$ alkyl group, $R_1$ is $C_2$–$C_4$ acyl group, X is $(OCH_2CH_2)$ or $(OCH_2(CH_3)CH)$ and n is a number from 1 to 4, diethylene glycol, triethylene glycol, an alkyl lactate, wherein the alkyl group has 1 to 6 carbon atoms, 1 methoxy-2-propanol, 1 methoxy-3-propanol, and 1 methoxy 2-, 3- or 4-butanol.

Representative members of the polypropylene glycol include dipropylene glycol and polypropylene glycol having a molecular weight of 200 to 1000, e.g., polypropylene glycol 400. Other satisfactory glycol ethers are ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, mono, di, tripropylene glycol monomethyl ether, propylene glycol monomethyl ether, ethylene glycol monohexyl ether, diethylene glycol monohexyl ether, propylene glycol tertiary butyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monomethyl ether, triethylene glycol monoethyl ether, triethylene glycol monopropyl ether, triethylene glycol monopentyl ether, triethylene glycol monohexyl ether, mono, di, tripropylene glycol monoethyl ether, mono, di tripropylene glycol monopropyl ether, mono, di, tripropylene glycol monopentyl ether, mono, di, tripropylene glycol monohexyl ether, mono, di, tributylene glycol mono methyl ether, mono, di, tributylene glycol monoethyl ether, mono, di, tributylene glycol monopropyl ether, mono, di, tributylene glycol monobutyl ether, mono, di, tributylene glycol monopentyl ether and mono, di, tributylene glycol monohexyl ether, ethylene glycol monoacetate and dipropylene glycol propionate.

The water insoluble organic ester compounds used in the instant invention are alipathic esters having the formulas of

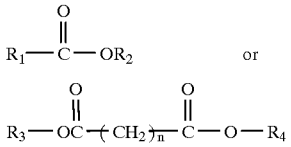

wherein $R_1$, $R_3$ and $R_4$ are $C_2$ to $C_8$ alkyl groups, more preferably $C_3$ to $C_7$ alkyl groups and $R_2$ is a $C_3$ to $C_8$ alkyl group, more preferably $C_4$ to $C_7$ alkyl group and n is a number from 3 to 8, more preferably 4 to 7.

The pHs of the final microemulsion, concentrated or diluted, will be dependent in large part on the identity of the cosurfactant compound, with the choice of the cosurfactant also being affected by cost and cosmetic properties, often particularly odor or fragrance. For example, microemulsion compositions which are to have a pH in the range of 1 to 10 may employ either an alkanol, propylene glycol, or ethylene glycol or propylene glycol ether or ester, or an alkyl phosphate as the sole cosurfactant but such pH range may be reduced to 1 to 8.5 when polyvalent metal salt is present.

In addition to their excellent capacity for cleaning greasy and oily soils, the low pH microemulsion formulations of this invention also exhibit excellent other cleaning properties. They satisfactorily remove soap scum and lime scale from hard surfaces when applied in neat (undiluted) form, as well as when they are diluted. For such applications onto originally hard shiny surfaces having surface deposits of lime scale and/or soap scum, which may also be soiled with oily and greasy deposits, the microemulsions may be of a pH in the 0.5 to 6 range, preferably 1 to 4 and more preferably 1.5 to 3.5. For general cleaning of oily and greasy surfaces, without lime scale or soap scum deposits, the pH may be in the range of 1 to 11 and sometimes 6-11 or 6–8 will be preferred and more preferred, respectively (for mildness and effectiveness).

The final essential component of the invented microemulsions is water. Such water may be tap water, usually of less than 150 ppm hardness, as $CaCO_3$, but preferably will be deionized water or water of hardness less than 50 ppm, as $CaCO_3$. The proportion of water in the microemulsion compositions generally is in the range of 15 to 85%.

The ingredients discussed above can be solubilized in one preferred embodiment of the invention in water and either optionally an alkyl monoethanol amide such as $C_{12}$–$C_{14}$ alkyl monoethanol amide (LMMEA) at a concentration of 0 to 5 wt. %, or an alkyl diethanol amides such as coco diethanol amide (CDEA) or lauryl diethanol amide (LDEA) at a concentration of 0 to 5 wt. %, preferably 0.5 wt. % to 3 wt. % and mixtures thereof. The solubilizing ingredient can also include 0 to 5 wt. %, preferably 0.1 wt. % to 3 wt. % of at least one water soluble salt of a $C_1$–$C_3$ substituted benzene sulfonate hydrotrope such as sodium xylene sulfonate or sodium cumene sulfonate or a mixture of said sulfonates. Inorganic alkali metal or alkaline earth metal salts such as sodium sulfate, magnesium sulfate, sodium chloride and sodium citrate can be added to the microemulsion at concentrations of 0.5 to 4.0 wt. %. Other ingredients which have been added to the compositions at concentrations of about 0.1 to 4.0 wt. percent are preservatives, color stabilizers, sodium bisulfite, ETDA, HETDA and proteins such as lexine protein.

In addition to the previously mentioned essential and optional constituents of the light duty liquid microemulsion detergent, one may also employ normal and conventional adjuvants, provided they do not adversely affect the properties of the detergent. Thus, there may be used various coloring agents and perfumes; sequestering agents such as ethylene diamine tetraacetates; magnesium sulfate heptahydrate; pearlescing agents and opacifiers; pH modifiers; etc. The proportion of such adjuvant materials, in total will normally not exceed 15% of weight of the detergent composition, and the percentages of most of such individual components will be about 0.1 to 5% by weight and preferably less than about 2% by weight. Sodium bisulfite can be used as a color stabilizer at a concentration of about 0.01 to 0.2 wt. %. Typical perservatives are dibromodicyanobutane, citric acid, benzylic alcohol and poly (hexamethylene-biguamide) hydrochloride and mixtures thereof.

In addition to the above-described essential ingredients required for the formation of the microemulsion composition, the compositions of this invention may possibly contain one or more additional ingredients which serve to improve overall product performance.

One such ingredient is an inorganic or organic salt or oxide of a multivalent metal cation, particularly $Mg^{++}$. The metal salt or oxide provides several benefits including improved cleaning performance in dilute usage, particularly in soft water areas, and minimized amounts of perfume required to obtain the microemulsion state. Magnesium sulfate, either anhydrous or hydrated (e.g., heptahydrate), is especially preferred as the magnesium salt. Good results also have been obtained with magnesium oxide, magnesium chloride, magnesium acetate, magnesium propionate and magnesium hydroxide. These magnesium salts can be used with formulations at neutral or acidic pH since magnesium hydroxide will not precipitate at these pH levels.

Although magnesium is the preferred multivalent metal from which the salts (inclusive of the oxide and hydroxide) are formed, other polyvalent metal ions also can be used provided that their salts are nontoxic and are soluble in the aqueous phase of the system at the desired pH level. Thus, depending on such factors as the nature of the primary surfactants and cosurfactant, and so on, as well as the availability and cost factors, other suitable polyvalent metal ions include aluminum, copper, nickel, iron, calcium, etc. can be employed. It should be noted, for example, that with the preferred sulfonate anionic detergent calcium salts will precipitate and should not be used. It has also been found that the aluminum salts work best at pH below 5 or when a low level, for example about 1 weight percent, of citric acid is added to the composition which is designed to have a neutral pH. Alternatively, the aluminum salt can be directly added as the citrate in such case. As the salt, the same general classes of anions as mentioned for the magnesium salts can be used, such as halide (e.g., bromide, chloride), sulfate, nitrate, hydroxide, oxide, acetate, propionate, etc.

Preferably, in the dilute compositions the metal compound is added to the composition in an amount sufficient to provide at least a stoichiometric equivalent between the anionic surfactant and the multivalent metal cation. For example, for each gram-ion of Mg++ there will be 2 gram moles of paraffin sulfonate, alkylbenzene sulfonate, etc., while for each gram-ion of $A1^{3+}$ there will be 3 gram moles of anionic surfactant. Thus, the proportion of the multivalent salt generally will be selected so that one equivalent of compound will neutralize from 0.1 to 1.5 equivalents, preferably 0.9 to 1.4 equivalents, of the acid form of the anionic detergent. At higher concentrations of anionic detergent, the amount of multivalent salt will be in range of 0.5 to 1 equivalents per equivalent of anionic detergent. The concentration of the magnesium sulfate is 0 to 4%, more preferably 0.1 to 2% by weight.

The concentrated and dilute clear microemulsion liquid all-purpose cleaning compositions of this invention are effective when used as is, without further dilution by water, but it should be understood that some dilution, without disrupting the microemulsion, is possible and often may be preferable, depending on the levels of surfactants, cosurfactants, water insoluble organic compounds, and other components present in the composition. For example, at preferred low levels of anionic dilutions up to about 50% will be without any phase separation (the microemulsion state will be maintained) and often much greater dilutions are operative. Even when diluted to a great extent, such as 2- to 10-fold or more, for example, the resulting compositions are often still effective in cleaning greasy, oily and other types of lipophilic soils.

In the final diluted form, the all-purpose liquids are clear microemulsions and exhibit satisfactory stability at reduced and increased temperatures. More specifically, such compositions remain clear and stable in the range of 5° C. to 50° C., especially 10° C. to 43° C. They exhibit a pH in the acid, neutral or alkaline range, e.g. 1–11, depending on intended end use, with acidic and neutral pHs, e.g. 2 to 7 or 2 to 8 being preferred and with acidic pHs, e.g. 1–4 or 2–3.5 being considered best for lime scale and soap scum removal applications. The liquids are readily pourable and exhibit a viscosity in the range of 5 to 150 or 200 centipoises, preferably 10 to 4 centipoises (cps) and more preferably 10 to 40 cps, as measured at 25° C. with Brookfield RVT Viscometer, using a No. 1 spindle rotating at 20 rpm. Usually the product viscosity, in the absence of thickening agent, will be no greater than 100 cps.

The liquid compositions are preferably packaged in manually operated spray dispensing containers of synthetic organic polymeric plastic, e.g. PVC, PET, polyethylene or polypropylene, which may include nylon closure, valve and nozzle parts, but they can also be packaged under pressure in aerosol containers. Such products, including the dispensers provided, are especially suitable for so-called spray-and-wipe applications but in the present operations wiping may be omitted and relatively little rinsing may be substituted for it.

Because the compositions, as prepared, are aqueous liquid formulations and because often no particular mixing procedure is required to be followed to cause formation of the desired microemulsions. The compositions are easily prepared, often simply by combining all of the components thereof in a suitable vessel or container. The order of mixing the ingredients in such cases is not particularly important and generally the various materials can be added sequentially or all at once or in the form of aqueous solutions or each or all of the primary detergents and cosurfactants can be separately prepared and combined with each other, followed by the water insoluble organic compound. However, to avoid any problems with the microemulsions breaking or not forming properly one may make a solution of the synthetic detergent(s) in water, dissolve the cosurfactant therein, and then admix in the water insoluble organic compound, which thus spontaneously forms the concentrated or dilute microemulsion, which operations are conducted at a temperature in the 5° to 50° C. range, preferably 10° to 43° C. and more preferably 20° to 30° C. If fatty acid is to be employed for its antifoaming effect, it will preferably be melted and added to the surfactant-cosurfactant solution, followed by the water insoluble organic compound. Dilute microemulsions can be made from the concentrated microemulsion by dilution with at least 50% thereof of water, with both the microemulsion and the water being in the described temperature range. The products resulting are of dispersed lipophilic phase droplet sizes in the range of 50 to 500 Å, preferably 100 to 500 Å, with the smaller particle sizes promoting better absorption of oily soils from soiled substrates to be cleaned.

DETAILED DESCRIPTION OF THE PREFERRED EMBODIMENT

The following examples illustrate liquid cleaning compositions of the present invention. Unless otherwise specified, all percentages and parts given in these examples, this specification and the appended claims are by weight and all temperatures are in ° C. The exemplified compositions are illustrative only and do not limit the scope of the invention.

EXAMPLE 1

The following examples were prepared at room temperature by dissolving the anionic and/or nonionic surfactants in the water, then dissolving the urea and then the alcohol solvents followed by admixing in the D-limonene, Isopar H, Exxate 1000, Exxate 1300, isooctanol, decane and/or $C_{13}$ acetate into the water solution to form a stable homogenous microemulsion. The formulas (wt. %) were tested for appearance, olive oil uptake, miniplates and volume of foam in ml at the start and end. The examples and test results are as follows:

| | A | B | C | D | E | F |
|---|---|---|---|---|---|---|
| $C_{14}$–$C_{17}$ Paraffin Sulfonate | 25.5 | 25.5 | 25.5 | 25.5 | 25.5 | 25.5 |
| $C_{12}$–$C_{14}$ Alcohol EO 2:1 Na Sulfate | 8.5 | 8.5 | 8.5 | 8.5 | 8.5 | 8.5 |
| PPG-2 Methyl Ether | 6 | 6 | 6 | 6 | 6 | 6 |
| Urea | 5 | 5 | 5 | 5 | 5 | 5 |
| D-limonene | 6 | 6 | | | | |
| Isobutyl Isobutyrate | | | 6 | | | |
| Isohexyl neopentanoate | | | | 6 | | |
| Dibutyl Adipate | | | | | 6 | |
| Diisopropyl Adipate | | | | | | 6 |
| Ethanol | | 4 | 4 | | | |
| Water | Bal. | Bal. | Bal. | Bal. | Bal. | Bal. |

| | Viscosity* (@25° C., cps) | Oil uptake kinetics (seconds) | | | | | Miniplates |
|---|---|---|---|---|---|---|---|
| A | 130 | 175 | 213 | 268 | 317 | 360 | 45 |
| B | 50 | 91 | 118 | 153 | 207 | 320 | 48 |
| C | 35 | 73 | 89 | 120 | 182 | 360 | 44 |
| D | 90 | 96 | 139 | 160 | 170 | 210 | 45 |
| E | 60 | 99 | 120 | 182 | 320 | >600 | 46 |
| F | 90 | 80 | 98 | 135 | 190 | 360 | 47 |

*measured with Brookfield LVT Viscometer, using a No. 2 spindle rotating at 30 rpm.

The test procedures are as follows:

Foam Longevity—Miniplate Test

A) Foam Longevity—Miniplate Test

Principle

The test aims at assessing the Foam Stability of a LDLD solution in presence of a fatty soil.

Soil

Vegetable shortening: Crisco (from us)

This fat is injected in the LDLD solution with a Syringe at a flow rate of 0.6 G/MIN.

Product Concentration

10 ML of a 5% LDLD Solution are added to 400 ML of water (+1.25 GR/L of LDLD)

Test Procedure

During 1 minute foam is generated with a brush (according a hypocycloidal pattern). The brush keeps moving to help fat emulsification. Fatty soil is then injected in the solution at a constant flow rate up to disappearance of the foam. Foam generation and disappearance are evaluated by photo electrical cell and recorded automatically.

Results

Miniplate number: $MP=(GC\times GF\times \Delta T)/0.12$

GC=Grease Coefficient

GF=Grease flow equal to (Total injected grease weight) (T2–T0)

ΔT=Time measured from the beginning of grease injection (T0) and the end of foam detection (T1)

0.1 2=Correlation coefficient to relate the calculated miniplate number to the number of dishes washed by hand in similar conditions T2=End of test, grease injection is stopped Extrapolation Actual plate number can be easily extrapolated from miniplate number by assuming that each large plate is solid with 3 GR of fat.

(Number of miniplates)×(weight of product)×0.08

B) Foam Test—Foam Volume

Principle

Produce foam by rotation of a graduated cylinder containing a detergent solution.

This method allows to define the speed of foam generation and the maximum foam height generated in presence of fat.

Soil

Corn oil

Product Concentration 0.75 G/L Detergent solution

Procedure 2 different products (including a reference) are simultaneously evaluated.

100 ML of a solution at 0.75 G/L of detergent at 47° C. is poured in a graduated cylinder.

1 Gr of corn oil is added to the solution.

The graduated cylinders are attached to the rotation assembly and allowed to turn 5 complete revolutions.

Foam height is recorded on the cylinder graduation.

The 5 complete revolutions are repeated 10 times.

(Foam height is recorded after each 5 complete revolutions).

Results

Start foam volume (ML)

End Foam volume (ML)

C) Dynamic Degreasing

Principle

Cleaning power under mechanical action of a LDLD in neat and diluted conditions.

Soil

Neat: A solution at 10% of fat (Beef tallow and hardened tallow) in chloroform (colored with dye for fat)

Diluted: A solution at 1% of fat (Beef tallow and hardened tallow) In chloroform (colored with dye for fat)

Soiling Procedure

The soil solution is uniformly sprayed on white formica tile.

Evaluation Procedure

2 Products are simultaneously evaluated.

Neat: 4 Gr of Product are put on the sponge.

Diluted: 10 Gr of a 1.2% LDLD solution per sponge.

The soiled tiles and the sponges are introduced in the carriers of

The Gardner Machine.

The Machine operates until 95% of the soil is removed.

Results

Expressed in number of strokes (back and forth) needed to remove 95% of the soil.

D) Olive Oil Uptake

Principle

Oil uptake of a dish liquid

Soil

Olive Oil

Product Concentration

Product as is

Procedure

In 50 ML of neat product start to add drops of olive oil. After each drop addition let the solution become clear again under agitation with a magnetic stirrer. If after 5 minutes, the solution is not clear, stop the addition of olive oil and record the amount of olive oil added.

Results

G of olive oil to reach saturation of 100 ML of product.

What is claimed:

1. A composition comprising approximately by weight:

a) 6 to 50% of at least one anionic surfactant;

b) 0.5 to 20% of an aliphatic organic ester compound having the formulas of;

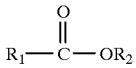

or

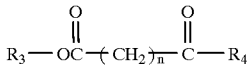

wherein $R_1$, $R_3$ , and $R_4$ are $C_2$ to $C_8$ alkyl groups, and $R_2$ is a $C_3$ to $C_8$ alkyl group, and n is a number from 3 to 8, c) 0 to 22% of a solubilizing agent;

d) 0.5 to 15% of at least one glycol ether cosurfactant; and e) the balance being water, wherein the composition has a pH of about 1 to 11 and is optically clear having at least 90% light transmission.

2. The composition of claim 1, wherein said glycol ether cosurfactant is a mono $C_1$–$C_6$ alkyl ether of $R(X)_nOH$ or $R_1(X)_nOH$ wherein R is a $C_1$–$C_6$ alkyl group, $R_1$ is a $C_2$–$C_4$ alkyl group, X is selected from the group consisting of $(OCH_2CH_2)$ and $(OCH_2CH(CH_3))$ and n is a number from 1 to 4.

3. The composition of claim 1, wherein said solubilizing agent is urea.

4. The composition of claim 5, further including a hydrotrope which is an aryl sulphonate.

5. The composition of claim 1, further including an alkanolamide.

* * * * *